United States Patent [19]

Koine

[11] 4,151,781

[45] May 1, 1979

[54] FLOATING MACHINE CANNON

[75] Inventor: Richard Koine, Ratingen, Fed. Rep. of Germany

[73] Assignee: Rheinmetall GmbH, Dusseldorf, Fed. Rep. of Germany

[21] Appl. No.: 859,255

[22] Filed: Dec. 9, 1977

[30] Foreign Application Priority Data

Dec. 9, 1976 [DE] Fed. Rep. of Germany ..... 2655708

[51] Int. Cl.[2] ..... F41D 11/24

[52] U.S. Cl. ..... 89/135; 89/42 B

[58] Field of Search ..... 89/42 B, 135

[56] References Cited

U.S. PATENT DOCUMENTS 3,537,353 11/1970 Nelson ..... 89/135

*Primary Examiner*—Stephen C. Bentley

[57] ABSTRACT

An improved floating machine cannon of the type utilizing the counter-recoil method of firing is disclosed wherein two normally open switches are used to detect when the breech block locks in place and when the recoil damper reaches the optimum point in its forward movement to commence the second and subsequent detonations. Detonation for the second and subsequent firing cycles can only occur at such time when both switches are closed.

5 Claims, 1 Drawing Figure

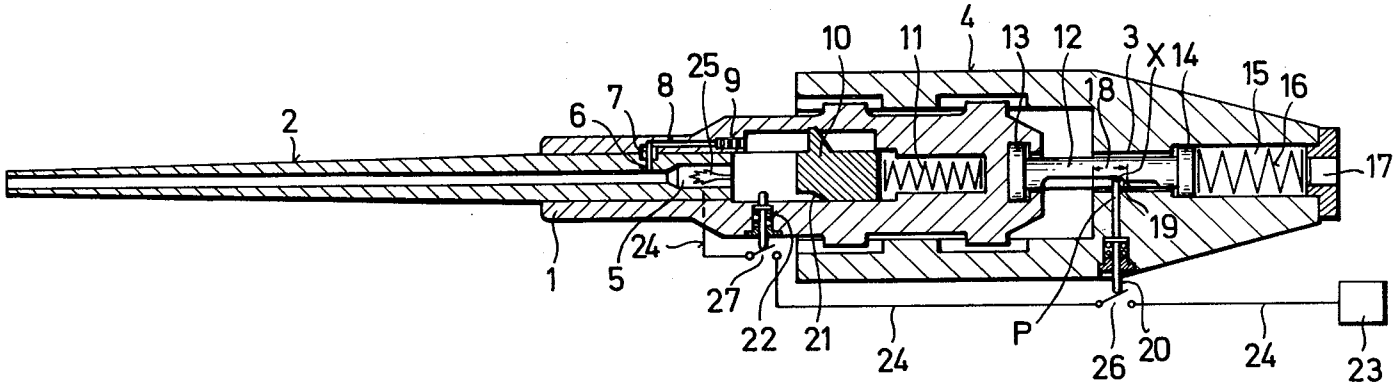
17
16
15
14
X
3
18
12
13
4
11
10
9
25
8
7
6
2
1
5
24
27
22
21
24
P
26
20
19
24
23

FLOATING MACHINE CANNON

The present invention relates to an improved floating machine cannon.

Machine cannons that have floating weapon housings are well known in the art. Thus floating machine cannons are described, for example, in the "Waffentechnisches Handbuch" ("Ordnance Engineering Handbook") 2, published by Rheinmetall, amended edition, Dusseldorf 1973, pp. 262–4.

This mounting method enables operation of the weapon in a counter-recoil manner which minimizes the recoil forces produced by detonation of the ammunition that are transmitted to the gun carriage. This is achieved by use of a rigidly locking breech block and a recoil damper which absorb the force of the recoil and return to their quiescent state awaiting the next detonation. The counter-recoil method of operation produces a greater aiming accuracy combined with a quieter and smoother operation. It also enables repetitive firing with little fluctuation in the firing cycle.

The degree of effectiveness of a machine cannon is determined by the relationship between percentage of hits and consumption of ammunition. The greater the accuracy of aim and the lower the consumption of ammunition, the more efficient is the cannon.

For every floating machine cannon there is a point during the forward movement of the recoil damper following detonation at which the next detonation should optimally occur. If the next detonation occurs when the recoil damper is in a position either forward of rear of this optimum position, the detonation will take place in a buffer zone reserved for the recoil and forward motion of the machine cannon. If this occurs, the efficiency of the recoil damper is diminished for the next firing cycle and the percentage of hits achieved is reduced. Machine cannons of the past have suffered from this drawback.

In a preferred embodiment, the cannon of the invention is provided with a rigidly locking breech block, a triggering section, a detonating section and a recoil device which couples the machine cannon with a gun carriage along a section measurable in the forward motion and recoil, an energy transmission device for the reception on the input side and delivery on the output side of primary energy, supplied in pulse form from at least one energy source, to weapon components which are to be actuated by the said energy and which contribute by their respective functions to a firing cycle, e.g. the breech block or a belt feed device, and a device for the transmission of a control order, derived from the development of the firing operation of one firing cycle, for the reception of a primary energy impulse for an immediately subsequent firing cycle.

The object of the present invention is to enable each detonation to occur at a time when the breech block is locked in place and the recoil damper is at its optimum point during its forward motion. This is accomplished by two normally open switches, one controlled by the position of the breech block within the weapon housing, the other controlled by the position of the piston rod within the gun carriage. When both the breech block and piston rod are at their proper positions, both switches, which are serially connected, are closed, transmitting energy to the detonating device and causing detonation of the ammunition.

The present invention insures accuracy of aim and the maximum number of sustained firings in the shortest time possible.

Although such novel features believed to be characteristic of the invention are pointed out in the claims, the invention may be further understood by reference to the description following and the accompanying drawing.

The single drawing is a view in section, along the longitudinal axis, of a machine cannon according to the present invention.

The drawing depicts the machine cannon constructed as a gas operated weapon. All details not essential to the invention have been omitted.

The machine cannon shown in the drawing comprises a weapon housing 1 which is fitted in front with a barrel 2 and is coupled at the rear to a gun carriage 4 via a recoil damper 3.

The barrel 2 contains a loading chamber 5 and a gas conducting bore 6 which passes through the wall of the barrel into an interchangeable nozzle 7 and then continues through the nozzle into a gas channel 8 located within the weapon housing. Said gas channel 8 leads to a cylinder with a gas piston 9 which accomplishes the locking and release of a reciprocable breech block 10. The breech block 10 is of rigid rectilinear construction and, at its rear end, engages a closing spring 11.

The recoil damper 3 comprises a recoil piston 14 which is attached to the rear end of a piston rod 12 and a hydraulic cylinder 15, which sets the recoil piston 14 in axial motion, located within the gun carriage 4 to the rear of recoil piston 14. A counter-recoil spring 16 is located within the hydraulic cylinder 15. A control device 17 for adjusting the recoil and forward motion of the recoil damper 3 is fitted at the rear of the hydraulic cylinder 15 and the gun carriage 4. The front end of the piston rod 12 is coupled to the weapon housing 1 through connecting device 13.

A flat section 18, of the piston rod 12 having a length including both the recoil and forward motion of the recoil damper 3, is formed on piston rod 12. The piston rod 12 contains, at a preselected optimum point for detonation located within section 18, a recoil control surface 19 of element X, control surface 19 riding upon the flat section 18. A recoil signal transmitter 20 engages section 18 at point P. The breech block 10 contains a block control surface 21 which engages, in its locked position, a block signal transmitter 22. A detonating energy source 23 is serially connected to a recoil switch 26 and a block switch 27 via a transmission line 24. The transmission line 24 terminates at detonating device 25 located within loading chamber 5.

In operation, following the first detonation, propulsive gas produced by the detonation is directed through the gas conducting bore 6, nozzle 7, gas channel 8 and into the cylinder containing gas piston 9, effectuating release of the breech block 10. Upon its release, the breech block 10, as a result of the recoil force of detonation, suddenly moves backward, transmitting potential energy to closing spring 11. When breech block 10 moves back, block control surface 21 breaks contact with block signal transmitter 22 which causes block switch 27 to revert to its normally open position, thereby opening the circuit.

The secondary energy arising from the recoil causes weapon housing 1 to travel backward within gun carriage 4 through the length of section 18. Piston 14 moves back into hydraulic cylinder 15, transmitting potential energy to counterrecoil spring 16. Meanwhile, the potential energy stored in closing spring 11 is released and causes breech block 10 to advance in a forward direction into its rigidly locked position, causing block control surface 21 to come into contact with block signal transmitter 22 thereby closing block switch 27. At this point, a unit of ammunition, which is not shown in the drawing, is introduced into the loading chamber 5.

Forward movement of the weapon housing 1 is achieved by release of the stored potential energy in the recoil damper 3 in the manner preselected by adjusting control device 17. When the forward motion of the recoil damper 3 brings recoil control surface 19 in contact with recoil signal transmitter 20 at point P, recoil switch 26 closes, completing the circuit and permitting energy from energy source 23 to be transmitted via transmission line 24 to the detonating device 25, so that the second firing occurs at that point on section 18 which was preselected as the optimum point in the forward movement (defined as the counter-recoil firing). As long as ammunition is present, the procedure described is repeated until a triggering device, not shown, is actuated.

The firing cycle can be increased or decreased by using a nozzle 7 with a gas conducting bore having a larger or smaller diameter. The control device 17 is adjusted in accordance with the nozzle 7 selected, so that the defined counter-recoil firing is ensured throughout the firing cycle. Element X can be situated at the most favorable counter-recoil point on section 18.

In the preferred embodiment shown in the drawing, the energy used to release the breech block 10 is derived from the propulsive gas produced by the detonation. However, if the machine cannon is equipped with an extraneous driving means using energy from, for example, a power supply mounted on the vehicle itself, then the energy used to release breech block 10 can be derived from an electric, hydraulic or pneumatic motor with an appropriate clutch or valve control system.

The invention is applicable to machine cannons with different types of drive, including the hybrid type. In addition, use of the invention is not limited to any particular type of carrier.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In a floating machine cannon of the type using a counter-recoil method of firing having a triggering section, a detonating section, a gun carriage having front and rear portions, a weapon housing axially movable within the front portion of said gun carriage, said weapon housing containing a rigidly locking breech block therein, a piston-type recoil device coupled at one end to said weapon housing and axially movable within said gun carriage at the other end, the improvement which comprises:

(a) means for transmitting a first signal when the breech block is rigidly locked;

(b) means for transmitting a second signal when the piston-type recoil device has reached a certain determinable point during its forward movement following a first detonation, this point being the optimum point at which a second or subsequent detonation should occur; and (c) means for combining the first and second signals so that the second and subsequent detonations occur at the precise time when both the first and second signals are present.

2. A floating machine cannon as recited in claim 1, in which the means for transmitting the first signal comprises:

(a) a block control surface located at the front end of the breech block; and (b) a normally open block switch which closes when coming into contact with said block control surface.

3. A floating machine cannon as recited in claim 2, in which the means for transmitting the second signal comprises:

(a) a recoil control surface located at the optimum point during the piston recoil cycle; and (b) a normally open recoil switch which closes when coming into contact with said recoil control surface.

4. A floating machine cannon as recited in claim 3, in which the combining means comprises a detonation energy source serially connected to the normally open block and recoil switches and thence connected to the detonating device whereby simultaneous closure of both switches is necessary for the energy source signal to be transmitted to the detonating device.

5. A floating machine cannon as recited in claim 1, further comprising adjusting means for controlling and preselecting the rate of oscillation of the recoil damper.

* * * * *